US010852675B2

(12) United States Patent
Ishii

(10) Patent No.: US 10,852,675 B2
(45) Date of Patent: Dec. 1, 2020

(54) IMAGE FORMING APPARATUS AND CONTROL METHOD OF IMAGE FORMING APPARATUS WITH MODE SELECTION

(71) Applicant: TOSHIBA TEC KABUSHIKI KAISHA, Tokyo (JP)

(72) Inventor: Hiroshi Ishii, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/228,202

(22) Filed: Dec. 20, 2018

(65) Prior Publication Data

US 2019/0377284 A1 Dec. 12, 2019

(30) Foreign Application Priority Data

Jun. 7, 2018 (JP) ..... 2018-109468

(51) Int. Cl.
*G03G 15/20* (2006.01)
*G03G 15/00* (2006.01)

(52) U.S. Cl.
CPC ..... *G03G 15/205* (2013.01); *G03G 15/50* (2013.01); *G03G 2215/209* (2013.01)

(58) Field of Classification Search
CPC ..... G03G 15/205; G03G 15/50; G03G 2215/209; G03G 15/6585
See application file for complete search history.

(56) References Cited

U.S. PATENT DOCUMENTS 5,073,799 A * 12/1991 Watanabe ..... G03G 15/205 219/216
8,849,161 B2 * 9/2014 Ogasawara ..... G03G 15/6585 399/223
8,918,002 B2 * 12/2014 Ogasawara ..... G03G 21/20 399/69
9,008,562 B2 * 4/2015 Yamaguchi ..... G03G 21/14 399/341
9,044,981 B2 * 6/2015 Imamiya ..... B41J 29/36
9,063,483 B2 * 6/2015 Katayama ..... G06K 15/14
(Continued)

FOREIGN PATENT DOCUMENTS

JP 2016-057369 A 4/2016

OTHER PUBLICATIONS

Search Report dated Oct. 16, 2019 received in corresponding European application No. 19 17 8145.9, 8 pages.

*Primary Examiner* — Arlene Heredia
(74) *Attorney, Agent, or Firm* — Foley & Lardner LLP

(57) ABSTRACT

An image forming apparatus includes an image forming unit, a fixing device, and a control circuit. The control circuit acquires a selection signal indicating which mode is selected from among options. The options include at least two modes, including a first mode in which an image is formed using a non-decolorable first toner, a second mode in which the image is formed using a decolorable second toner, and a third mode in which the image is erased by heating a sheet on which the image is formed by the second toner using the fixing device at a decolorizing temperature. The control circuit sets a different standby temperature in accordance with the mode indicated by the selection signal, and controls a temperature of the fixing device to be the standby temperature, in a standby state before an operation start reception.

10 Claims, 8 Drawing Sheets

(56) References Cited

U.S. PATENT DOCUMENTS

| | | | | |
|---|---|---|---|---|
| 9,104,947 | B2 * | 8/2015 | Umetsu | B41J 2/32 |
| 9,164,440 | B2 * | 10/2015 | Kimoto | G03G 15/205 |
| 9,452,629 | B1 * | 9/2016 | Ishii | G03G 15/2039 |
| 9,952,548 | B2 * | 4/2018 | Ueno | G03G 15/205 |
| 9,977,377 | B1 * | 5/2018 | Takahashi | G03G 15/6582 |
| 10,289,044 | B1 * | 5/2019 | Morino | G03G 15/205 |
| 2014/0255054 | A1 | 9/2014 | Katayama | |
| 2014/0333706 | A1 | 11/2014 | Imamiya | |
| 2018/0024477 | A1 * | 1/2018 | Katakura | G03G 15/2039 399/70 |
| 2018/0196377 | A1 * | 7/2018 | Iguchi | G03G 15/205 |

* cited by examiner

| | NON-DECOLORABLE PRINTING | DECOLORABLE PRINTING | DECOLORIZING |
|---|---|---|---|
| REFERENCE TEMPERATURE | 130°C | 100°C | 120°C |

| | NON-DECOLORABLE PRINTING | DECOLORABLE PRINTING | DECOLORIZING |
|---|---|---|---|
| REFERENCE TEMPERATURE | 130°C | 100°C | 120°C |
| INITIAL STANDBY TEMPERATURE | 130°C | 100°C | 120°C |
| STANDBY TEMPERATURE AFTER CHANGE | 115°C | 110°C | 110°C |

IMAGE FORMING APPARATUS AND CONTROL METHOD OF IMAGE FORMING APPARATUS WITH MODE SELECTION

CROSS-REFERENCE TO RELATED APPLICATION

This application is based upon and claims the benefit of priority from Japanese Patent Application No. 2018-109468, filed Jun. 7, 2018, the entire contents of which are incorporated herein by reference.

FIELD

Embodiments described herein relate generally to an image forming apparatus and a control method of an image forming apparatus.

BACKGROUND

There is an image forming apparatus capable of forming an image by using a toner selected from a decolorable toner and a non-decolorable toner. In fixing using a fixing device of such an image forming apparatus, a temperature at which the decolorable toner is fixed onto a sheet is different from a temperature at which the non-decolorable toner is fixed onto the sheet. A predetermined time period is required to change the temperature of the fixing device. It is preferable that a time period from an operation start instruction, such as an instruction of image formation to the start of the operation, such as an image forming operation, is short.

DETAILED DESCRIPTION

Figure 1:
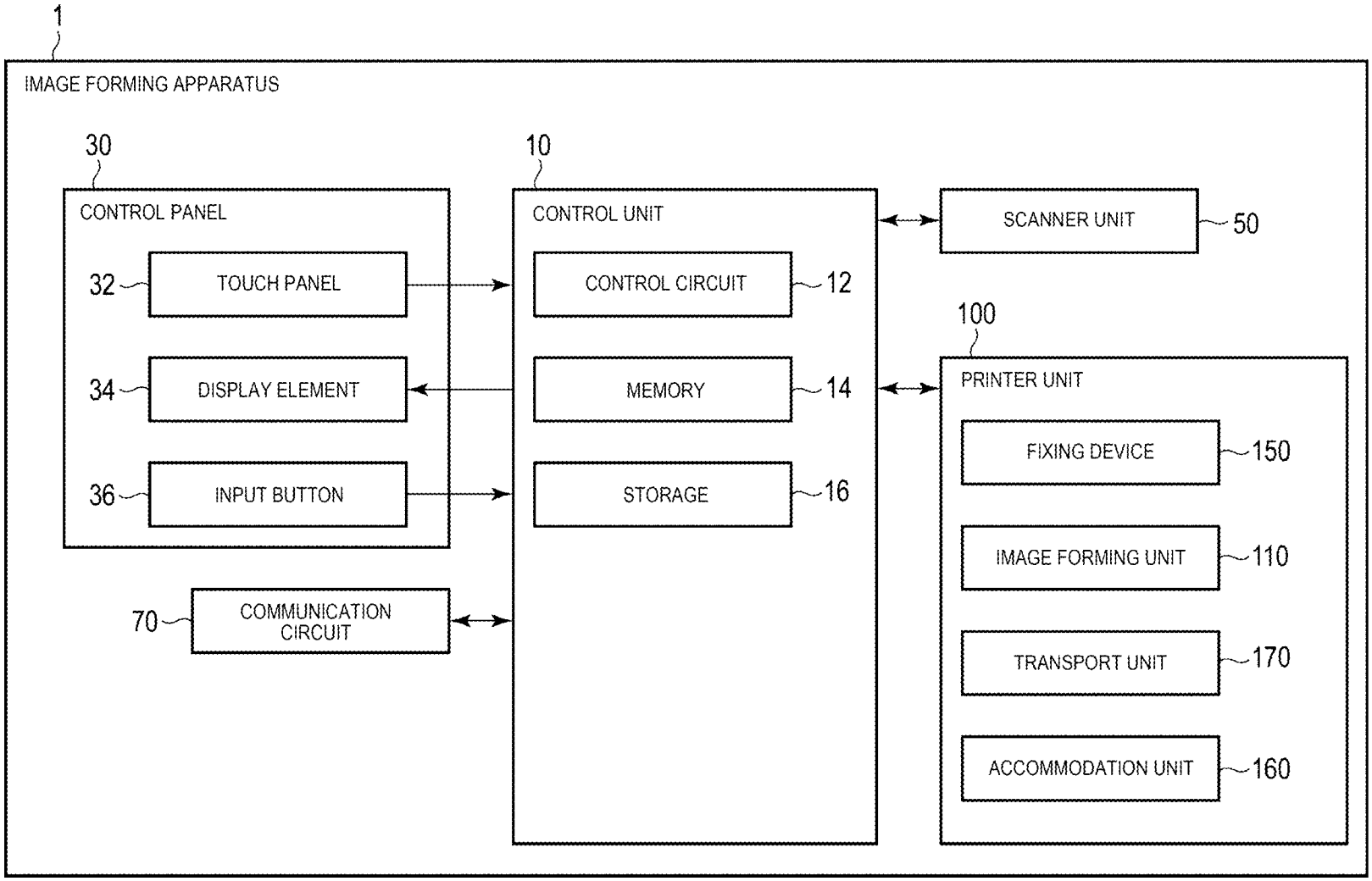
FIG. 1 is a block diagram schematically illustrating a configuration example of an image forming apparatus according to at least one embodiment.

In order to solve the above-mentioned problems, an object of certain exemplary embodiments is to provide an image forming apparatus which can shorten a time necessary to make the image forming apparatus ready for an operation.

In general, according to at least one embodiment, an image forming apparatus includes an image forming unit (image former), a fixing device (fixer), and a control circuit. The image forming unit forms an image on a surface of a sheet by using a non-decolorable first toner having a first fixing reference temperature or a decolorable second toner having a second fixing reference temperature different from the first fixing reference temperature. The fixing device heats and fixes an image, by the first toner, formed on the surface of the sheet at the first fixing reference temperature or heats and fixes an image, by the second toner, formed on the surface of the sheet at the second fixing reference temperature. The control circuit (i) acquires a selection signal indicating which mode is selected from among options, while at least two modes among a first mode in which the image is formed using the first toner, a second mode in which the image is formed using the second toner, and a third mode in which the image is erased by heating the sheet on which the image is formed by the second toner using the fixing device at a decolorizing temperature are the options, (ii) sets a standby temperature in accordance with the mode indicated by the selection signal, and (iii) controls a temperature of the fixing device to be the standby temperature, in a standby state before an operation start reception (i.e., before receiving an indication or signal that an operation is started).

At least one embodiment will be described with reference to the drawings. An image forming apparatus 1 according to at least one embodiment is an apparatus having an electrophotographic printing function. In at least one embodiment, it is described that the image forming apparatus 1 is a digital multifunction peripheral (MFP) having a copy function, a print function, a facsimile function, a scanner function and the like. The image forming apparatus 1 can perform non-decolorable printing and decolorable printing.

The non-decolorable printing is appropriate for creating documents to be stored. In the non-decolorable printing, a non-decolorable toner is used. The non-decolorable toner is also referred to as a permanent toner, an ordinary toner or the like. The decolorable printing is printing for creating a document which can "erase" printed characters and the like. In the decolorable printing, a decolorable toner is used.

The decolorable toner is a toner which is decolorized by external stimulation such as temperature, light having a specific wavelength, or pressure. In at least one embodiment, the decolorable toner is a toner which is decolored by applying heat at a certain temperature or higher. Here, the temperature at which the decolorable toner is decolorized will be referred to as a decolorizing temperature. In addition, in at least one embodiment, "decolorizing" refers to making an image, such as characters formed with a color different from the color of the background of a paper sheet visually not recognizable. Here, the color includes not only a chromatic color but also an achromatic color, such as white and black.

Apparatus Configuration

FIG. 1 is a block diagram schematically illustrating a configuration example of the image forming apparatus 1 according to at least one embodiment. As illustrated in FIG. 1, the image forming apparatus 1 includes a control unit 10, a control panel 30, a scanner unit 50, a communication circuit 70, and a printer unit 100.

The control unit 10 controls the operation of each part of the image forming apparatus 1. The control unit 10 includes a control circuit 12, a memory 14, and a storage 16.

The control circuit 12 includes, for example, a central processing unit (CPU). In addition to the CPU or instead of the CPU, the control circuit 12 may include an application specific integrated circuit (ASIC), a field programmable gate array (FPGA), a graphics processing unit (GPU) or the like.

The memory 14 can include a read only memory (ROM) and a random access memory (RAM). The ROM records, for example, an activation program. The RAM functions as, for example, a main memory of the CPU.

The storage 16 includes, for example, a hard disk drive (HDD). In addition to the HDD or instead of the HDD, the storage 16 may include a semiconductor storage medium, such as a solid state drive (SSD). The storage records various types of information, such as control programs and parameters used in the CPU. Further, the storage 16 can record image data to be printed.

The control panel 30 can include a touch panel 32, a display element 34, and an input button 36. The display element 34 is a display element, such as a liquid crystal display or an organic electroluminescence (EL) display. The display element 34 displays information, such as a state and various settings of the image forming apparatus 1. In addition, the display element 34 displays options and the like for changing settings and the like of the image forming apparatus 1. The touch panel 32 is provided on the display element 34. The touch panel 32 forms a touch screen together with the display element 34. The touch panel 32 acquires an instruction of a user. The input button 36 includes, for example, a print start button. The input button 36 acquires the instruction of the user.

The scanner unit 50 reads images, such as characters, figures, and pictures drawn on a sheet 200 placed at a predetermined position. Therefore, the scanner unit 50 includes an image capturing element. For the scanner unit 50, a CCD method may be adopted, a CIS method may be adopted, or another method may be adopted. The scanner unit 50 generates image data based on the read image. The scanner unit 50 transmits the generated image data to the control unit 10. The control unit 10 stores the received image data in the storage 16, transmits the image data to the printer unit 100, and transmits the received image data to another device via the communication circuit 70.

The communication circuit 70 is a circuit for communicating with an external device on the outside of the image forming apparatus 1. The image forming apparatus 1 is connected to a personal computer (PC), mobile device, or the like, for example, via the communication circuit 70 and a network connected to the communication circuit 70. Further, the image forming apparatus 1 may be connected to a telephone line via the communication circuit 70.

The printer unit 100 forms an image. The printer unit 100 forms an image on the surface of the paper sheet, for example, based on the image data generated by the scanner unit 50. Further, the printer unit 100 may form an image on the surface of the paper sheet based on the image data transmitted by another information processing device via the network.

Here, an example of the printer unit 100 using a tandem type toner image transfer unit will be described. The printer unit 100 includes an image forming unit 110, a fixing device 150, an accommodation unit (a housing or storage unit) 160, and a transport unit (transporter) 170. The accommodation unit 160 accommodates the sheet 200, such as a paper sheet, cloth, or a plastic film, therein. The sheet 200 is transported in order from the accommodation unit 160 to the image forming unit 110 and the fixing device 150 by the transport unit 170. The image forming unit 110 forms images, such as characters, figures, and pictures, on the sheet 200. The fixing device 150 fixes the image formed on the sheet 200. In this manner, an image is printed on the sheet 200, such as a paper sheet.

Figure 2:
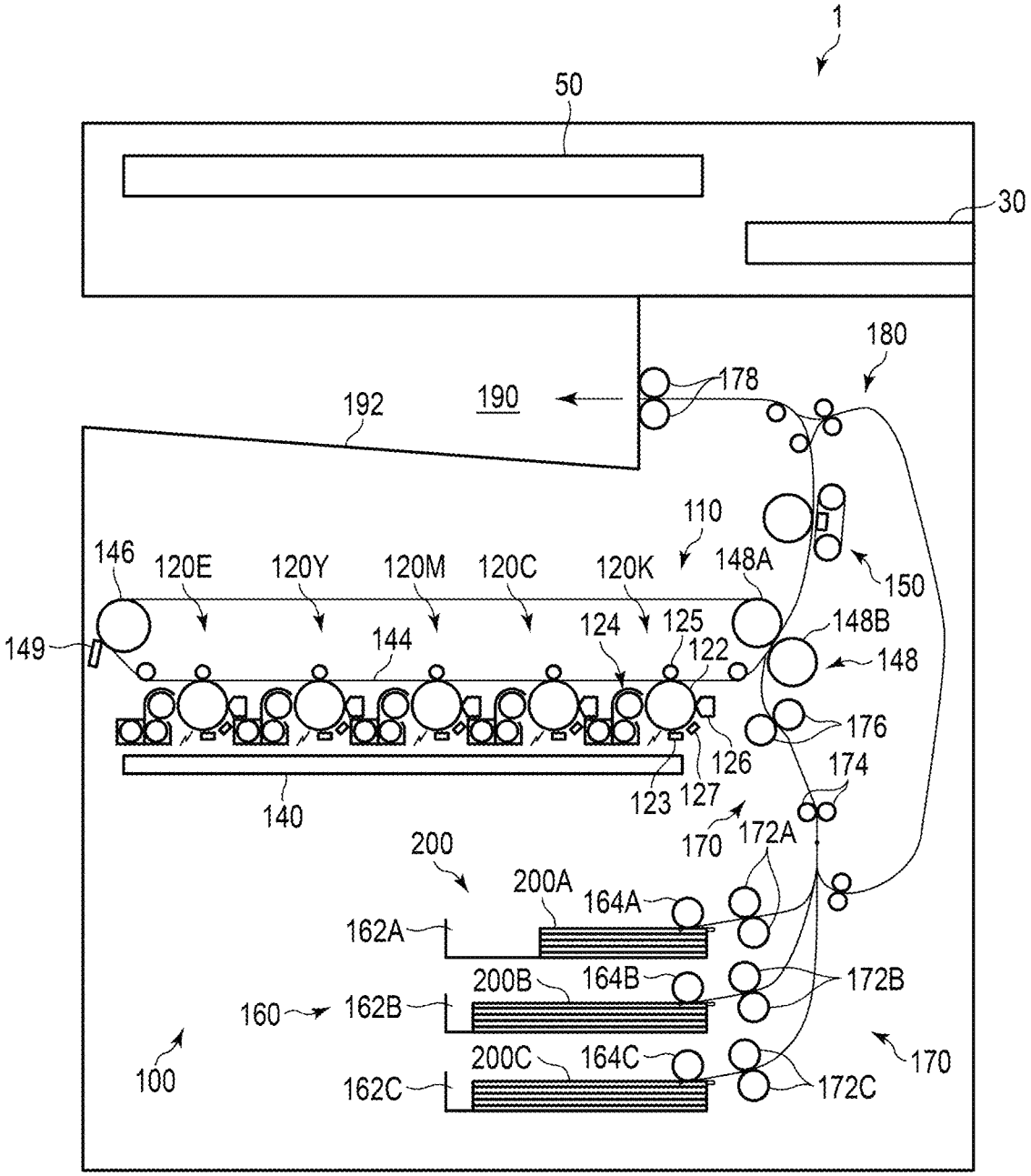
FIG. 2 is a view schematically illustrating a configuration example of a printer unit.

FIG. 2 is a view schematically illustrating an outline of a configuration example of the printer unit 100. The printer unit will be described with reference to FIG. 2.

The accommodation unit 160 includes a plurality of paper feed cassettes. In the example illustrated in FIG. 2, the accommodation unit 160 includes a first paper feed cassette 162A, a second paper feed cassette 162B, and a third paper feed cassette 162C. Each paper feed cassette stores the sheet 200 of a predetermined size and type therein. In other words, the first paper feed cassette 162A accommodates a first sheet 200A therein. The second paper feed cassette 162B accommodates a second sheet 200B therein. The third paper feed cassette 162C accommodates a third sheet 200C therein. Here, an example of a case where there are three paper feed cassettes is illustrated, but the number of paper feed cassettes may vary from one to a different number of cassettes.

Each paper feed cassette is provided with a pickup roller. In other words, the first paper feed cassette 162A includes a first pickup roller 164A. The second paper feed cassette 162B includes a second pickup roller 164B. The third paper feed cassette 162C includes a third pickup roller 164C. Each pickup roller takes out the sheets 200 one by one from each paper feed cassette. Each pickup roller supplies the taken-out sheet 200 to the transport unit 170.

The transport unit 170 transports the sheet 200 in the printer unit 100. The transport unit 170 includes a first transport roller, a second transport roller 174, and a resistance roller 176. The first transport roller transports the sheet 200 supplied by the pickup roller to the second transport roller 174. The first transport roller includes a first roller 172A, a second roller 172B, and a third roller 172C. The first roller 172A transports the sheet 200 supplied by the first pickup roller to the second transport roller 174. The second roller 172B transports the sheet 200 supplied by the second pickup roller to the second transport roller 174. The third roller 172C transports the sheet 200 supplied by the third pickup roller to the second transport roller 174. The second transport roller 174 transports the sheet 200 further to the resistance roller 176. The resistance roller 176 transports the sheet 200 to a transfer unit 148 in accordance with the timing at which the transfer unit 148 of the image forming unit 110 which will be described later transfers the toner image to the sheet 200.

On a transport path after the image is formed on the sheet 200, the fixing device 150 which will be described later and a third transport roller 178 of the transport unit 170 are disposed. In addition, in the transport unit 170, a reversing unit 180 for reversing the recording medium when forming images on both sides of the sheet 200 is disposed.

A paper discharge unit 190 receives the sheet 200 discharged from the printer unit 100 through the third transport roller 178. The paper discharge unit 190 may be an opening portion or a tray having a paper sheet receiving surface 192.

The image forming unit 110 forms a toner image on the surface of the sheet 200. The image forming unit 110 includes a plurality of developing units, an exposing device 140, an intermediate transfer belt 144, a transfer unit 148, a replenishing unit (not illustrated), and a transfer belt cleaner 149. The developing units are provided as many as the number of toner types.

In the example illustrated in FIG. 2, the image forming unit 110 is configured to perform monochrome and color printing of the non-decolorable printing and the decolorable printing with a single color. In other words, the image forming unit 110 includes a black developing unit 120K, a cyan developing unit 120C, a magenta developing unit 120M, a yellow developing unit 120Y, and a decolorable developing unit 120E. The black developing unit 120K is a developing unit that corresponds to a black (K) toner. The cyan developing unit 120C is a developing unit that corresponds to a cyan (C) toner. The magenta developing unit 120M is a developing unit that corresponds to a magenta (M) toner. The yellow developing unit 120Y is a developing unit that corresponds to a yellow (Y) toner. The decolorable developing unit 120E is a developing unit that corresponds to a decolorable toner. When the monochrome non-decolorable printing and the decolorable printing with a single color may be performed, the black developing unit 120K and the decolorable developing unit 120E are provided. Each developing unit has a similar configuration.

Each developing unit includes a photoconductive drum 122 that functions as an image carrier. In each developing unit, around the photoconductive drum 122, a charging device 123, a developing device 124, a primary transfer roller 125, a cleaning unit 126, and a static eliminator 127 are provided. In addition, the exposing device 140 is provided below the charging device 123 and the developing device 124.

The intermediate transfer belt 144 is an endless belt. The intermediate transfer belt 144 passes between the photoconductive drum 122 of each developing unit and the primary transfer roller 125. Furthermore, the intermediate transfer belt 144 is wound around a support roller 148A of the transfer unit 148 and another support roller 146. The intermediate transfer belt 144 rotates counterclockwise in FIG. 2.

The photoconductive drum 122 has a photoconductive layer on the surface. The photoconductive drum 122 rotates clockwise in FIG. 2 around an axis. The charging device 123 uniformly charges the photoconductive layer of the surface of the photoconductive drum 122. For example, the charging device 123 charges the surface of the photoconductive drum 122 to a negative polarity.

The exposing device 140 is provided at a position that faces the photoconductive drum 122 of each developing unit. The exposing device 140 includes a semiconductor laser light source. The exposing device 140 irradiates the surface of the photoconductive drum 122 of each developing unit with laser light via an optical system, such as a polygon mirror. Under the control of the control unit 10, the exposing device 140 controls operations including light emission based on the image data. On the surface of the photoconductive drum 122, a pattern of static electricity is formed as an electrostatic latent image at the position irradiated with the laser light. In addition, instead of the laser light source, the exposing device 140 may use a light emitting diode (LED).

The developing device 124 develops the electrostatic latent image on the surface of the photoconductive drum 122 with the toner. In other words, the toner adheres to the electrostatic latent image of the photoconductive drum 122. According to this, the toner image is formed on the surface of the photoconductive drum 122.

The primary transfer roller 125 faces the photoconductive drum 122 and sandwiches the intermediate transfer belt 144. The primary transfer roller 125 functions as a bias roller. The primary transfer roller 125 transfers the toner image on the surface of the photoconductive drum 122 onto the intermediate transfer belt 144. The transfer is referred to as primary transfer. The black developing unit 120K, the cyan developing unit 120C, the magenta developing unit 120M, and the yellow developing unit 120Y can multiple transfer toner images of each color onto the intermediate transfer belt 144.

The cleaning unit 126 is provided at a part subsequent to the position where the toner image on the surface of the photoconductive drum 122 is transferred onto the intermediate transfer belt 144. The cleaning unit 126 scrapes off and removes an un-transferred toner or the like on the surface of the photoconductive drum 122. The toner removed by the cleaning unit 126 is collected in a waste toner tank and discarded.

The discharging device 127 faces the photoconductive drum 122 that passed through the cleaning unit 126. The static eliminator 127 irradiates the surface of the photoconductive drum 122 with light. By the light irradiation, the photoconductive layer is destaticized and the charge of the photoconductive layer is made uniform.

The transfer unit 148 includes the support roller 148A and a secondary transfer roller 148B. The support roller 148A and the secondary transfer roller 148B are configured to sandwich the intermediate transfer belt 144 and the sheet 200 from both sides in a thickness direction. The support roller 148A is a driving roller of the intermediate transfer belt 144. The secondary transfer roller 148B faces the support roller 148A with the intermediate transfer belt 144 interposed therebetween. The transfer unit 148 transfers the charged toner image onto the surface of the intermediate transfer belt 144 to the surface of the sheet 200. The transfer is referred to as second transfer.

The transfer belt cleaner 149 is disposed between the transfer unit 148 and the developing unit in the moving direction of the intermediate transfer belt 144. After the toner image is transferred from the intermediate transfer belt 144 to the sheet 200, the transfer belt cleaner 149 removes the toner that has not been transferred on the surface of the intermediate transfer belt 144.

Figures 3, 4:
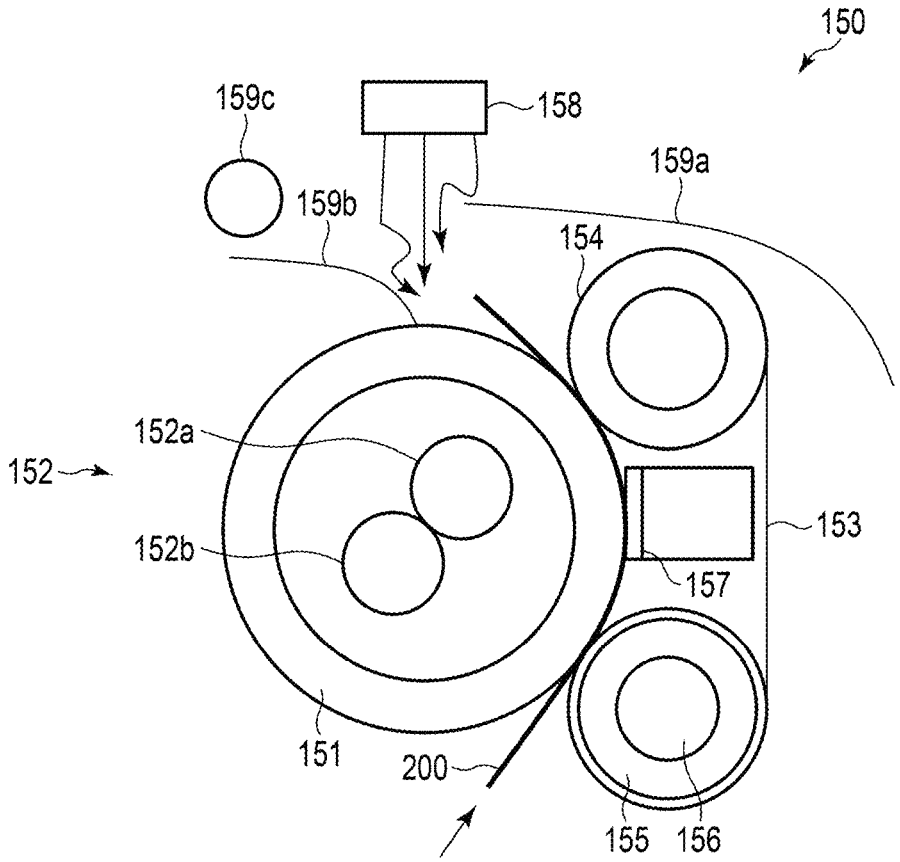
FIG. 3 is a view schematically illustrating a configuration example of a fixing device.
FIG. 4 is a view illustrating an example of a reference temperature of a heat roller of the fixing device in each operation mode.

The fixing device 150 applies heat and pressure to the sheet 200. The fixing device 150 fixes the toner image transferred to the sheet 200 by the heat and the pressure. FIG. 3 is a view illustrating an outline of a configuration example of the fixing device 150. The fixing device 150 includes a heat roller 151, a fixing belt 153, an output roller 154, a fixing belt heat roller 155, and a nip pad 157.

The heat roller 151 is a heat roller for heating a toner image forming surface (hereinafter, referred to as "fixing surface") side of the sheet 200. The heat roller 151 has, for example, a configuration in which an outer circumferential surface of a tubular aluminum base body is coated with a resin layer, such as a fluororesin layer. The heat roller 151 includes a heater 152 as a heat source.

The heater 152 is a heating body for heating the heat roller 151. As an example, the heater 152 includes a heater lamp that emits high heat. In the example of FIG. 3, the heater 152 is configured of a center lamp 152*a* and a side lamp 152*b*. The center lamp 152*a* and the side lamp 152*b* are, for example, halogen lamps with power consumption of 600 W. In addition, the center lamp 152*a* mainly heats the central portion of the heat roller 151 in a longitudinal direction (axial direction). The side lamp 152*b* mainly heats the end portion in the longitudinal direction of the heat roller 151.

The fixing belt 153 is an endless belt for applying heat and pressure to the sheet 200 from the side opposite to the fixing surface. The fixing belt 153 is wound around the output roller 154 and the fixing belt heat roller 155. The fixing belt 153 is disposed at a position facing the heat roller 151. A nip is formed between the heat roller 151 and the fixing belt 153.

The output roller 154 is a roller for pressing the sheet 200 at an exit of the nip. The fixing belt heat roller 155 is a roller having a function of heating the fixing belt 153. In order to heat the sheet 200 from both sides, the fixing belt heat roller 155 heats the fixing belt 153. The fixing belt heat roller 155 includes a heater lamp 156 which is a heating body for heating the fixing belt heat roller 155. As an example, the heater lamp 156 is a halogen lamp with power consumption of 300 W. The fixing belt 153 is heated by the heat of the heater lamp 156 transmitted from the fixing belt heat roller 155.

The nip pad 157 is a pressurizing member for pressing the fixing belt 153 against the outer circumferential surface of the heat roller 151. The nip pad 157 is disposed at a position that faces the heat roller 151 with the fixing belt 153 interposed therebetween. The nip pad 157 is, for example, a prismatic member.

The fixing device 150 includes a cooling mechanism 158. The cooling mechanism 158 includes a fan. The cooling mechanism 158 sends wind to the heat roller 151 as necessary and cools the heat roller 151. In other words, the temperature of the heat roller 151 can be adjusted by heating by the heater 152 and by cooling by the cooling mechanism 158. Further, the cooling mechanism 158 cools the sheet 200 that passes through the fixing device 150 as necessary.

In the vicinity of the heat roller 151, a temperature sensor (not illustrated) for measuring the temperature of the heat roller 151 is provided. Similarly, in the vicinity of the fixing belt 153, a temperature sensor (not illustrated) for measuring the temperature of the fixing belt 153 is provided. The temperature sensors may be contact type temperature sensors or non-contact type temperature sensors.

The fixing device 150 passes the sheet 200 to which the toner image is transferred in the direction of the arrow in the drawing. The sheet 200 is heated and pressurized by a nip formed between the heat roller 151 and the fixing belt 153. The toner image is fixed to the sheet 200 by heat and pressure received from the heat roller 151 and the fixing belt 153.

The sheet 200 on which the image has been fixed is transported along a paper discharge guide 159*a* and a transport guide 159*b* and transported in the direction of the reversing unit 180 by a paper discharge roller 159*c*.

In addition, in the fixing device 150, a fixing method referred to as so-called on-demand fixing or the like, in which the toner image is fixed onto a paper sheet by heating through a film-like member, may be adopted.

In addition, the fixing device 150 can also decolorize the image printed on the sheet 200 by heating the sheet 200 printed by using the decolorable toner at a decolorizing temperature or higher. In other words, the image forming apparatus 1 can function as an image forming and image erasing apparatus capable of performing both image formation and image erasing.

Outline of Image Forming Operation of Printer Unit

An outline of the image forming operation by the printer unit 100 will be described. Under the control of the control unit 10, the printer unit 100 operates. When performing image formation based on the instruction of the user or the like, the control unit 10 causes each unit of the printer unit 100 to operate as follows.

The transport unit 170 transports the sheet 200 from the accommodation unit 160. The charging device 123 receives a charging bias voltage from a power source (not illustrated) and charges the photoconductive drum 122. The exposing device 140 irradiates the laser light to the photoconductive drum 122 based on the input image data. An electrostatic latent image is formed on the photoconductive drum 122 at a position irradiated with the laser light. The developing device 124 supplies the toner to the surface of the photoconductive drum 122 on which the electrostatic latent image is formed.

For example, in a case of performing the monochrome non-decolorable printing, in the black developing unit 120K, the developing device 124 develops the electrostatic latent image on the surface of the photoconductive drum 122 with the black (K) toner. In a case of performing the decolorable printing, in the decolorable developing unit 120E, the developing device 124 develops the electrostatic latent image on the surface of the photoconductive drum 122 with the decolorable toner.

In a case of performing the non-decolorable color printing, in the yellow developing unit 120Y, the developing device 124 develops the electrostatic latent image on the surface of the photoconductive drum 122 with the yellow (Y) toner. In the magenta developing unit 120M, the developing device 124 develops the electrostatic latent image on the surface of the photoconductive drum 122 with magenta (M) toner. In the cyan developing unit 120C, the developing device 124 develops the electrostatic latent image on the surface of the photoconductive drum 122 with cyan (C) toner. In the black developing unit 120K, the developing device 124 develops the electrostatic latent image on the surface of the photoconductive drum 122 with black (K) toner.

The photoconductive drum 122 receives a primary transfer bias voltage applied from the power source to the primary transfer roller 125, and transfers the toner image to the intermediate transfer belt 144. On the intermediate transfer belt 144, the decolorable toner image, the yellow (Y) toner image, the magenta (M) toner image, the cyan (C) toner image, and the black (K) toner image are primarily transferred.

The transport unit 170 transports the sheet 200 to the transfer unit 148. The intermediate transfer belt 144 receives the secondary transfer bias voltage applied from the power source to the secondary transfer roller 148B, and transfers the toner image to the sheet 200 in the transfer unit 148. The sheet 200 to which the toner image has been transferred is transported to the fixing device 150. The fixing device 150 applies heat and pressure to the sheet 200, and fixes the toner image transferred to the sheet 200.

In addition, when the images are formed on both sides of the sheet 200, the reversing unit 180 reverses the sheet 200 after the fixing processing. The reversing unit 180 transports the reversed sheet 200 to the second transport roller 174 of the transport unit 170. In addition, image formation is performed again.

The sheet 200 after the fixing processing is discharged from the paper discharge unit 190 by the transport unit 170. In this manner, the image forming operation is completed.

Outline of Decolorizing Operation of Printer Unit

At the time of image decolorizing, the accommodation unit 160 accommodates the sheet 200 on which an image is formed by using the decolorable toner. When the image decolorizing mode is selected, the heat roller 151 and the fixing belt 153 of the fixing device 150 are heated. When the start of the decolorizing operation is instructed and the temperatures of the heat roller 151 and the fixing belt 153 reach the appropriate temperatures, the transport unit 170 transports the sheet 200. At this time, the transport unit 170 transports the sheet 200 in the accommodation unit 160 to the fixing device 150 without stopping by the resistance roller 176. The fixing device 150 heats the sheet 200 and decolorizes the image on the sheet 200. The transport unit 170 discharges the sheet after decolorizing to the paper discharge unit 190.

When the paper feeding is started in the decolorizing mode, the discharged paper sheet reaches a high temperature, and accordingly, a sticking phenomenon in which the paper sheet adheres due to the toner can occur. In order to suppress the sticking phenomenon, the cooling mechanism 158 provided in the fixing device 150 operates. When the decolorizing of the set number of sheets 200 is completed, or when the sheets 200 of the accommodation unit 160 run out, the operation of the image decolorizing mode is completed.

Temperature of Fixing Device

FIG. 4 illustrates the reference of an operating temperature of each heat roller 151 when performing the non-decolorable printing, when performing the decolorable printing, and when performing the decolorizing operation. The temperature will be referred to as the reference temperature. The operating temperature does not need to completely match the reference temperature, and may be higher or lower than the reference temperature within a predetermined range. In at least one embodiment, the first fixing reference temperature which is the reference temperature of the heat roller 151 in a case of the non-decolorable printing is 130° C. The second fixing reference temperature which is the reference temperature of the heat roller 151 in a case of the decolorable printing is 100° C. The reference temperature of the heat roller 151 in a case of the decolorizing operation is 120° C. In at least one embodiment, the temperature of the heat roller 151 is adjusted to a temperature in the vicinity of the reference temperature during the operation in accordance with each of the operation modes. Such a reference temperature is recorded in the storage 16, for example, as a table. In addition, similarly, regarding the temperature of the fixing belt 153, the reference temperature for each of the non-decolorable printing, the decolorable printing, and the decolorizing operation is recorded in the storage 16 as a table, for example.

Operation Screen Example

Figure 5:
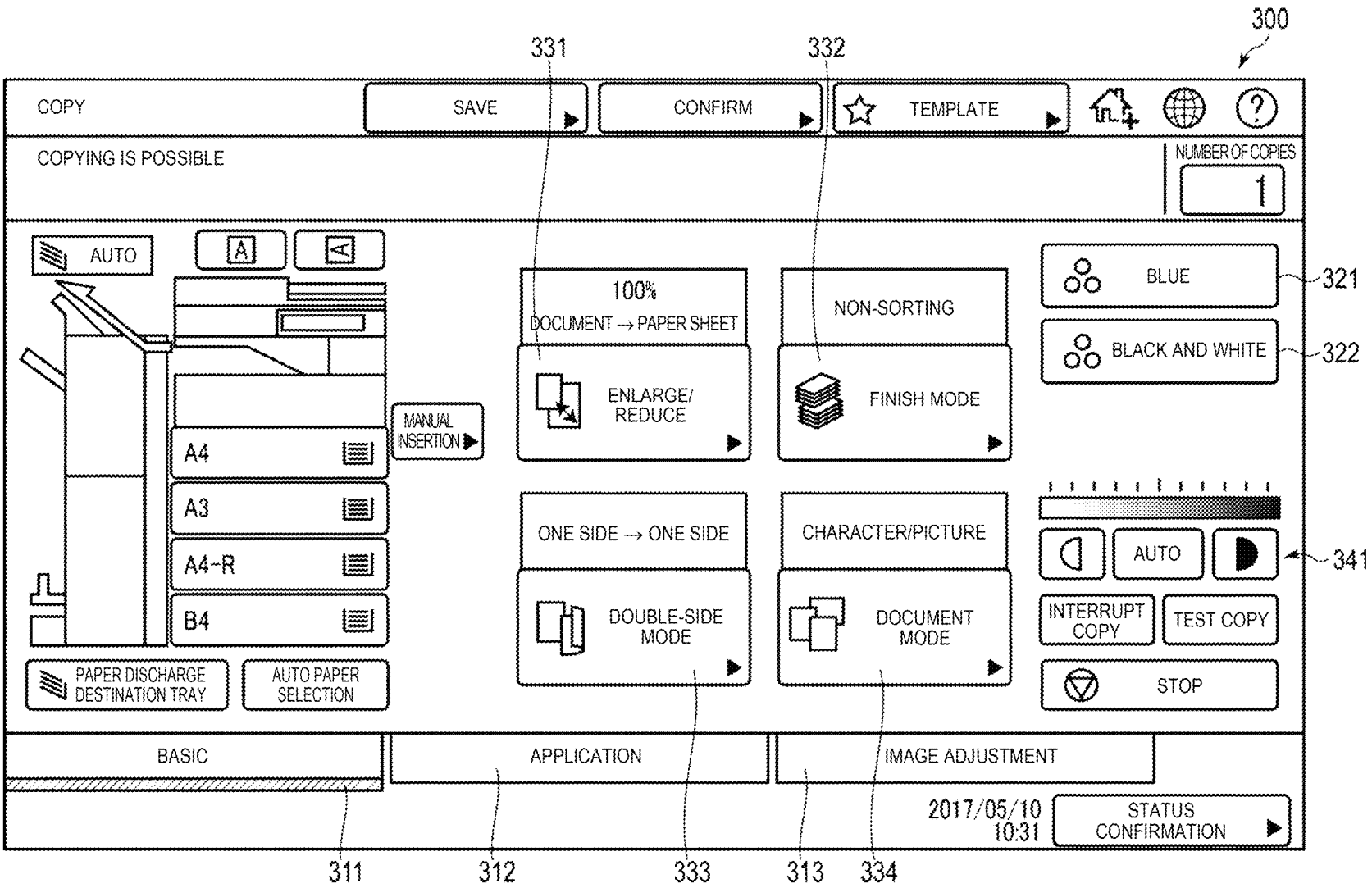
FIG. 5 is a view illustrating an example of a screen displayed on a control panel.

FIG. 5 illustrates an example of a screen 300 displayed on the display element 34 of the control panel 30 when the copy mode is selected. The screen 300 is configured so as to be capable of acquiring the intention of the user by presenting various types of information and detecting that a part of the screen 300 is selected by the touch panel 32.

The screen 300 is configured such that a basic tab 311, an application tab 312, and an image adjustment tab 313 are selected. The basic tab 311 is used for selecting the screen for performing basic settings related to copying. The application tab 312 is for selecting the screen for performing various application settings related to copying. The image adjustment tab 313 is for selecting the screen for performing the setting related to the image adjustment related to copying. The example in FIG. 5 illustrates a case where the basic tab 311 is selected.

In at least one embodiment, the decolorable printing and the non-decolorable printing can be selected. In the decolorable printing, a blue decolorable toner is used such that the decolorable printing can be recognized. In the non-decolorable printing, a black non-decolorable toner is used. The color of each toner may be other colors. Further, color printing may be possible. The screen 300 of the basic tab 311 includes a blue icon 321 for selecting the decolorable printing and a black and white icon 322 for selecting the non-decolorable printing. The user selects the blue icon 321 when it is desirable to make a copy using the decolorable toner. The user selects the black and white icon 322 when it is desirable to make a copy using the non-decolorable toner. In addition, the image forming apparatus 1 is configured such that the user can freely select which one of the decolorable printing and the non-decolorable printing is set as initial setting and can set the printing in advance.

The screen 300 includes an enlargement and reduction icon 331, a finish mode icon 332, a double-side mode icon 333, and a document mode icon 334. When the enlargement and reduction icon 331 is selected, a setting screen for setting enlarged printing, reduced printing, a magnification and the like is displayed. By using the screen, the user can select various settings, such as enlarged printing, reduced printing, and the like. When the finish mode icon 332 is selected, a screen for setting such as sorting the printed materials is displayed. By using the screen, the user can make settings, such as sorting the printed materials. When the double-side mode icon 333 is selected, a screen for setting the double-side printing or the like is displayed. By using the screen, the user can make settings of the double-side printing or the like. When the document mode icon 334 is selected, a screen for selecting whether the document is a character or a picture is displayed. By using the screen, the user can select the type of document.

In addition, the screen 300 includes a density adjustment icon 341. The user can adjust a print density by using the density adjustment icon 341.

Overview of Operation of Image Forming Apparatus

The operation of the image forming apparatus 1 will be described. The image forming apparatus 1 assumes the state of the power saving mode when no print command is input and the operation is not being performed. In the power saving mode state, when receiving a print command from a PC or the like connected to the network, the image forming apparatus 1 is activated and executes the printing in accordance with a print command. In addition, in the standby state, when the facsimile is received, the image forming apparatus 1 is activated and executes the received printing of the facsimile based on the received signal. In addition, when the control panel 30 is operated so as to execute the scanner function in the power saving mode, the image forming apparatus 1 is activated and executes the operation in accordance with the operation. In addition, when the control panel 30 is operated so as to execute the copy function in the power saving mode, the image forming apparatus 1 is activated and executes the operation in accordance with the operation.

The image forming apparatus 1 is configured such that the user can select one of the non-decolorable printing and the decolorable printing as an initial setting mode. The user can select a mode which is more frequently used from the non-decolorable printing and the decolorable printing as the initial setting mode in accordance with the use mode of the image forming apparatus 1 and set the printing in advance. The image forming apparatus 1 may be configured so as to be capable of selecting either the non-decolorable printing or the decolorable printing as the initial setting mode for each of the copy function, the print function, and the facsimile function.

For example, in the copy function, when the non-decolorable printing mode is set as the initial setting mode, the operation is as follows. When being activated, the image forming apparatus 1 performs standby for the non-decolorable printing in the initial setting mode. When a copy instruction is input, the image forming apparatus 1 performs the non-decolorable printing. For example, after a certain time period has elapsed after the printing, the image forming apparatus 1 clears various settings. The setting of the operation mode is also cleared and the image forming apparatus 1 continues the standby for the non-decolorable printing in the initial setting mode. Meanwhile, when the blue icon 321 is selected, the image forming apparatus 1 is switched to the decolorable printing mode and stands by for the decolorable printing. Here, when the copy instruction is input, the image forming apparatus 1 performs the decolorable printing. For example, after a certain time period has elapsed after the printing, the image forming apparatus 1 clears various settings. The setting of the operation mode is also cleared and the image forming apparatus 1 continues the standby for the non-decolorable printing in the initial setting mode.

Conversely, when the decolorable printing mode is set as the initial setting mode, and when the black and white icon 322 is not selected, the image forming apparatus 1 stands by in the decolorable printing mode and operates. When the black and white icon 322 is selected, the image forming apparatus 1 is switched to the standby for the non-decolorable printing and operates. At this time, after the printing, the image forming apparatus 1 returns to the standby for the decolorable printing in the initial setting mode.

Operation Related to Copying

Figure 6:
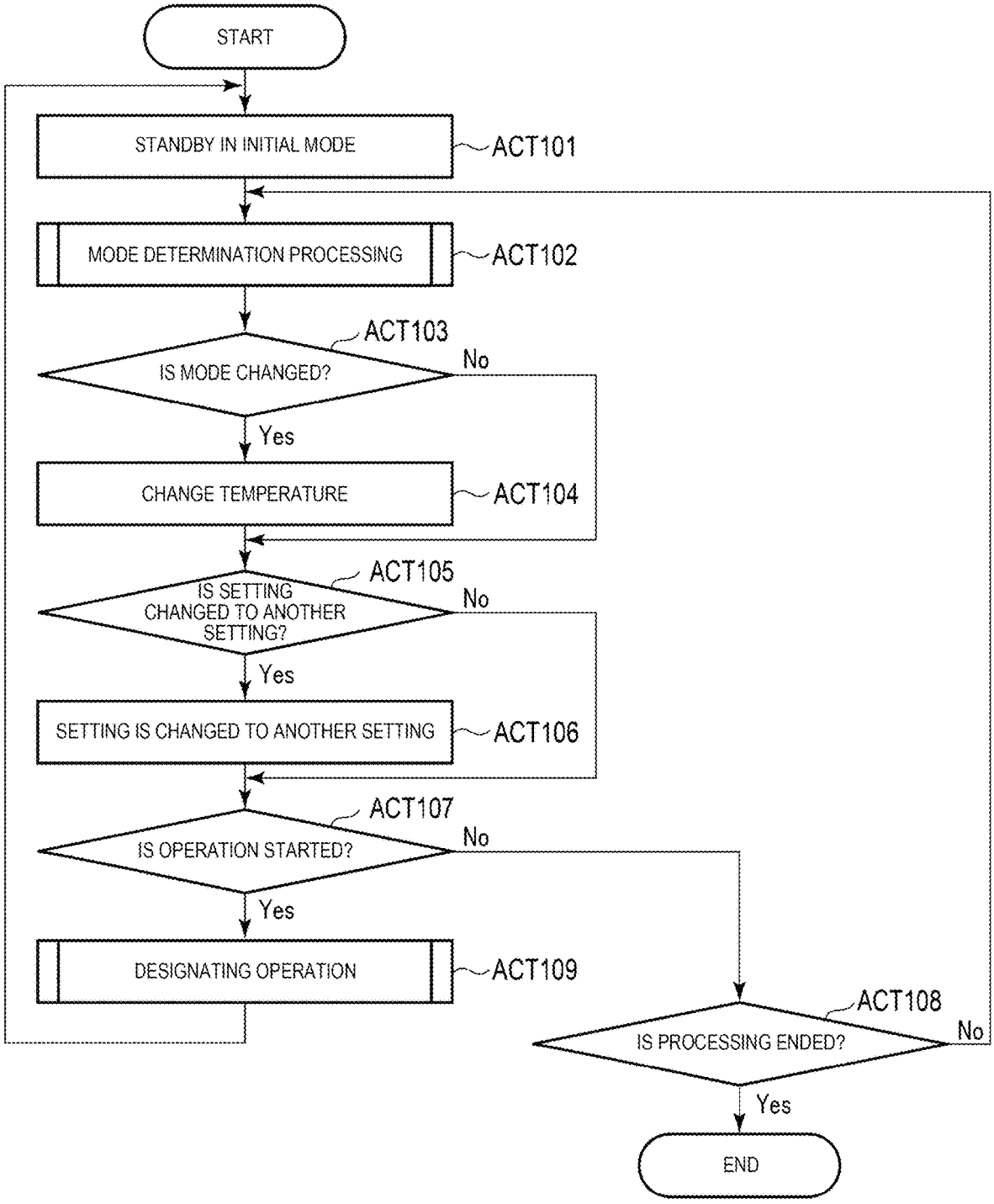
FIG. 6 is a flowchart schematically illustrating an example of an operation related to copying.

An example of an operation related to copying will be described. FIG. 6 is a flowchart illustrating an outline of the processing related to the copying. The processing illustrated in FIG. 6 is processing performed, for example, when the control panel 30 is operated and the image forming apparatus 1 is activated from the power saving mode. Here, a case where there are two modes of the non-decolorable printing mode and the decolorable printing mode as operation modes will be described.

In ACT 101, the control circuit 12 stands by in a state that corresponds to the mode which is initially set. When the non-decolorable printing is selected as the mode which is initially set, the temperature of the heat roller 151 is adjusted to, for example, 130° C. which is a reference temperature of the non-decolorable printing. At this time, the temperature of the fixing belt 153 is adjusted to, for example, approximately 100° C. When the decolorable printing is selected as the initial setting mode, the temperature of the heat roller 151 is adjusted to, for example, 100° C. which is a reference temperature of the decolorable printing. At this time, the temperature of the fixing belt 153 is adjusted to, for example, approximately 100° C.

In ACT 102, the control circuit 12 performs mode determination processing of performing determination related to the mode change. In the mode determination processing, the control circuit 12 performs the processing of determining the change of the operation mode. In at least one embodiment, the control circuit acquires a signal related to a mode selection of the user from the control panel 30 as a selection signal. The control circuit 12 determines the operation mode based on the acquired selection signal. For example, when the blue icon 321 is selected in a state where the currently selected mode is the non-decolorable printing mode, the control circuit 12 determines to change the operation mode to the decolorable printing mode. When the black and white icon 322 is selected in a state where the currently selected mode is the non-decolorable printing mode, the control circuit 12 determines to change the operation mode to the non-decolorable printing mode.

In ACT 103, the control circuit 12 determines whether or not to change the operation mode. When the operation mode is not changed, the processing proceeds to ACT 105. When the operation mode is changed, the processing proceeds to ACT 104.

In ACT 104, the control circuit 12 changes the temperature of the fixing device 150 to a new standby temperature. In the example, the standby temperature is the reference temperature. For example, when the operation mode is changed from the non-decolorable printing to the decolorable printing, the temperature of the heat roller 151 of the fixing device 150 is changed from 130° C. to 100° C. When the operation mode is changed from the decolorable printing to the non-decolorable printing, the temperature of the heat roller 151 is changed from 100° C. to 130° C. Thereafter, the processing proceeds to ACT 105.

In ACT 105, the control circuit 12 determines whether or not other settings have been changed. The other setting change is a setting other than the operation mode and may include the following. A change of copy magnification by selecting the enlargement and reduction icon 331 may be included. The setting change, such as sorting, by selecting the finish mode icon 332 can be included. The setting change, such as one-side or double-side setting of the document and printed materials, by selecting the double-side mode icon 333 can be included. The setting change, such as characters or pictures, by selecting the document mode icon 334 may be included. The setting change, such as density of printing by selecting the density adjustment icon 341 may be included. The setting of the number of copies may be included.

In ACT 105, when it is determined that other settings have not been changed, the processing proceeds to ACT 107. When other settings are changed, the processing proceeds to ACT 106. In ACT 106, the control circuit 12 performs various settings in accordance with the input of the user. Thereafter, the processing proceeds to ACT 107.

In ACT 107, the control circuit 12 determines whether or not an operation start instruction has been input, that is, whether or not an image formation start has been received. When the operation start instruction is not input, the processing proceeds to ACT 108. In ACT 108, the control circuit 12 determines whether or not to complete the copy operation. For example, when a predetermined time period has elapsed without any operation, it is determined to complete the copy operation. When it is determined to complete the copy operation, the processing is completed, and the image forming apparatus 1 shifts to the power saving mode. When it is determined that the copy operation is not completed, the processing returns to ACT 102.

In other words, the change of the operation mode, the change of other settings, and the like are performed, and the input of the operation start instruction is waited. In general, the user first determines the operation mode and then performs various settings. Therefore, while performing various settings, the temperature of the fixing device 150 can be adjusted to the reference temperature.

In ACT 107, when it is determined that the operation start instruction has been input, the processing proceeds to ACT 109. In ACT 109, the control circuit 12 performs a designating operation. For example, when the start of printing by copying is input, printing by copying is performed.

Figure 7:
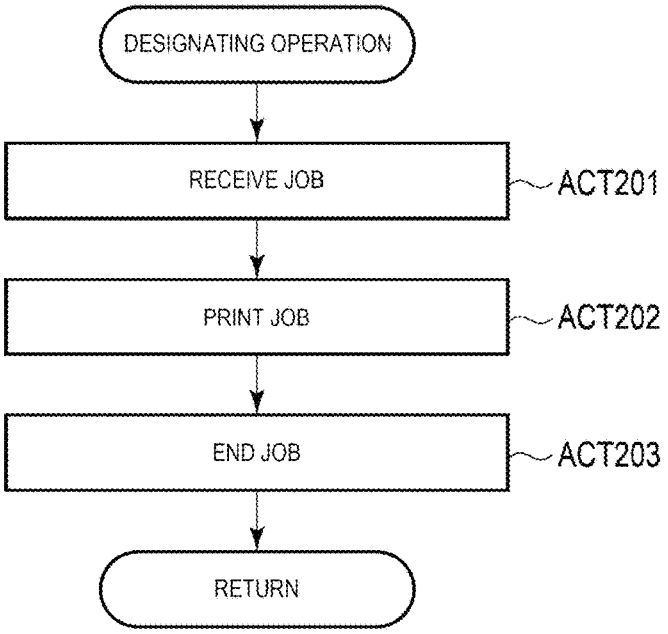
FIG. 7 is a flowchart schematically illustrating an example of a printing operation.

Processing related to the printing performed as the designating operation in ACT 109 will be described with reference to a flowchart illustrated in FIG. 7. In ACT 201, the control circuit 12 causes the scanner unit 50 to scan the document and receives a print job. In ACT 202, the control circuit 12 executes the printing in accordance with the received job. Here, when the temperature of each part of the fixing device 150 is an appropriate temperature close to the reference temperature, the printing is immediately performed. When the temperature of the fixing device 150 has not reached an appropriate temperature, the printing is performed after the fixing device 150 reaches an appropriate temperature. After the printing, in ACT 203, the control circuit 12 completes the job. Accordingly, the designating operation related to the printing is completed.

After the designating operation of ACT 109, the processing returns to ACT 101. In other words, regardless of the setting of the current operation mode, the control circuit 12 assumes the standby state again in the initial setting mode. For example, the description when the initial setting is the non-decolorable printing is as follows. When the temperature of the heat roller 151 of the fixing device 150 is adjusted to 130° C. and the non-decolorable printing is performed, after this, the temperature of the heat roller 151 is maintained to be 130° C. After the temperature of the heat roller 151 is adjusted to 100° C. and the decolorable printing is performed, after this, the temperature of the heat roller 151 is heated and maintained to be 130° C. The timing of returning to the initial setting mode may be immediately after the printing or may be after a predetermined time period has elapsed after the printing. The initialized setting may include not only the operation mode, such as the non-decolorable printing mode or the decolorable printing mode, but also the setting changed in ACT 106.

As described above, according to at least one embodiment, the temperature of the fixing device 150 is adjusted to an appropriate temperature in accordance with the setting of the operation modes of any of the non-decolorable printing or the decolorable printing, before the operation start instruction is input, that is, in the standby state before the operation start reception. Even when the operation mode is changed, the temperature of the fixing device 150 is readjusted in accordance with the change. Therefore, the image forming apparatus 1 can shorten the time period from the operation start instruction to the print start. For the user, since the waiting time is shortened, stress is reduced and the overall time for job completion is lowered.

For example, the initial setting is the non-decolorable printing and the temperature of the heat roller 151 is adjusted to 130° C. When the operation mode is changed to the decolorable printing and the temperature of the heat roller 151 is lowered to 100° C. after the instruction to the printing start is input, the time period for cooling the heat roller 151 to the temperature at which the printing is performed is required. The cooling time can be, for example, approximately 15 seconds. According to at least one embodiment, the time period can be shortened.

MODIFICATION EXAMPLES

Variation of Mode Change Determination Processing

In certain above-described embodiments, whenever the blue icon 321 or the black and white icon 322 is selected by using the control panel, the operation mode is immediately switched to the selected operation mode. The change of the operation mode accompanies the change of the temperature of the fixing device 150. Therefore, when it is assumed that an erroneous operation related to the change of the operation mode has been performed, it is preferable not to immediately switch the operation mode. Here, the following modification examples of the mode change determination processing may be adopted.

First Example

Figure 8:
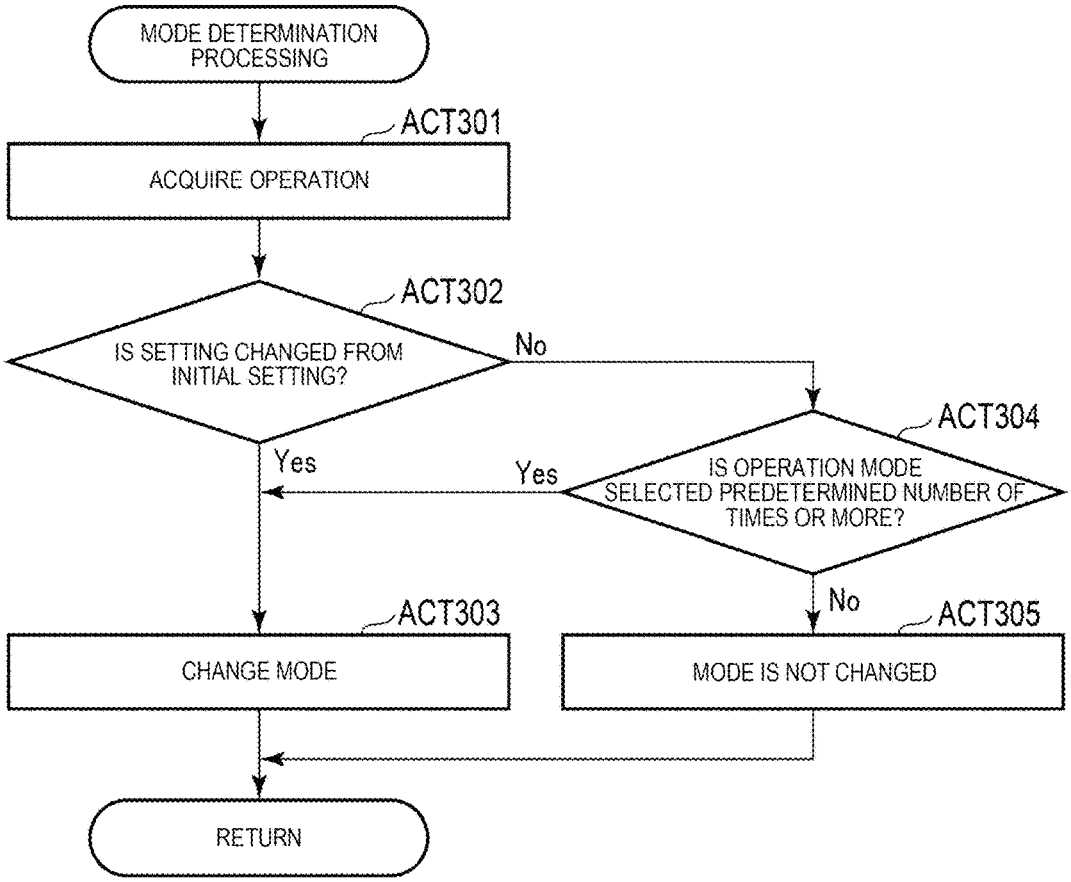
FIG. 8 is a flowchart schematically illustrating a first modification example of mode determination processing.

A first example of the mode determination processing performed in ACT 102 will be described with reference to a flowchart illustrated in FIG. 8. When the operation mode is continuously changed, there is a possibility that the instruction by the user is erroneous. Therefore, in the first example, when the instruction to change the operation mode is issued a plurality of number of times, the operation mode is not immediately switched. When the operation mode is selected a predetermined number of times, the operation mode is changed.

In ACT 301, the control circuit 12 acquires information on the operation input to the control panel 30 by the user. In ACT 302, the control circuit 12 determines whether or not the change in the input operation mode is a first change of the operation mode from the initial setting. When it is determined that the change is the first change from the initial setting, the processing proceeds to ACT 303.

In ACT 303, the control circuit 12 determines to change the operation mode in accordance with the instruction from the user. Thereafter, the mode change determination processing is completed. As a result, it is determined to change the operation mode in ACT 103, and the temperature of the fixing device 150 is changed in ACT 104. In this manner, when the operation mode is changed for the first time from the initial setting, the operation mode is immediately changed to a designated mode. For example, when the initial setting mode is the non-decolorable printing mode and the blue icon 321 is selected for the first time, it is determined to change the mode to the decolorable printing mode. Otherwise, when the initial setting mode is the decolorable printing mode and the black and white icon 322 is selected for the first time, it is determined to change the mode to the non-decolorable printing mode.

In ACT 302, when it is determined that the change instruction of the operation mode is not the first change from the initial setting, the processing proceeds to ACT 304. In ACT 304, the control circuit determines whether or not the selected operation mode has been selected a predetermined number of times or more. When the operation mode is selected the predetermined number of times or more, the processing proceeds to ACT 303. In other words, the control circuit 12 determines to change the operation mode to the selected mode.

In ACT 304, when it is determined that the selected number of times is less than the predetermined number of times, the processing proceeds to ACT 305. In ACT 305, the control circuit 12 counts up a counter that counts the selected number of times. The control circuit 12 determines not to change the mode, and completes the mode change determination processing. Since the mode change determination processing is repeatedly performed, when the blue icon 321 or the black and white icon 322 is repeatedly selected, any processing proceeds to ACT 303.

For example, when the initial setting mode is the non-decolorable printing mode and the blue icon 321 is selected for the first time, it is determined to change the mode to the decolorable printing mode. At this time, the temperature of the heat roller 151 of the fixing device 150 is changed from 130° C. which is the reference temperature of the non-decolorable printing while 100° C. which is the reference temperature of the decolorable printing is the target value. The black and white icon 322 is selected while the temperature is being lowered. The blue icon 321 and the black and white icon 322 are disposed to be close to each other. In this case, there is a concern that selection of the black and white icon 322 by the user is an erroneous operation. Here, the processing proceeds to ACT 304 and does not immediately change the operation mode. In other words, the temperature of the fixing device 150 is subsequently lowered toward 100° C.

When the selection of the black and white icon 322 of the user is not an erroneous operation, the user is expected to continuously select the black and white icon 322 because the operation mode is not changed. When the black and white icon 322 is selected a predetermined number of times or more, it is determined to change the operation mode in ACT 303. Here, the predetermined number of times is, for example, three times. In other words, when the black and white icon 322 is selected three times in total, the operation mode is switched to the non-decolorable printing mode. At this time, the temperature of the heat roller 151 is raised again to 130° C.

It is considered that the user alternately selects the black and white icon 322 and the blue icon 321. In at least one embodiment, the number of times the blue icon 321 is selected and the number of times the black and white icon 322 is selected are respectively counted. When the selected number of times is equal to or greater than the predetermined number of times, it is determined to change the operation mode to the corresponding operation mode. In addition, the image forming apparatus 1 may be configured such that it is determined to change the operation mode to the operation mode as long as the blue icon 321 or the black and white icon 322 is continuously selected a predetermined number of times.

In this manner, when it is apparent that the selection, such as the continuous selection of the blue icon 321 or the black and white icon 322, is definitely an intention of the user, the operation mode is changed. According to the example, the temperature of the fixing device 150 is unnecessarily changed, and as a result, the time period until starting the printing is prevented from becoming longer.

Second Example

A second example of the mode change determination processing performed in ACT 102 will be described with reference to a flowchart illustrated in FIG. 9. When the operation mode is continuously changed, there is a possibility that the instruction by the user is erroneous. In the second example, in such a case, when the predetermined time period has elapsed since the instruction to change the operation mode was input, the operation mode is changed.

In ACT 401, the control circuit 12 acquires information on the operation input to the control panel 30 by the user. In ACT 402, the control circuit 12 determines whether or not the change of the input operation mode is a first change of the operation mode from the initial setting. When it is determined that the change is the first change from the initial setting, the processing proceeds to ACT 403.

In ACT 403, the control circuit 12 determines to change the operation mode in accordance with the instruction from the user. Thereafter, the mode change determination processing is completed. As a result, it is determined to change the operation mode in ACT 103, and the temperature of the fixing device 150 is changed in ACT 104.

In ACT 402, when it is determined that the change instruction of the operation mode is not the first change from the initial setting, the processing proceeds to ACT 404. In ACT 404, the control circuit 12 determines whether or not a predetermined time has elapsed since the operation mode change was operated. When the predetermined time period has elapsed, the processing proceeds to ACT 403. In other words, the control circuit 12 determines to change the operation mode to the selected mode. When the operation mode change is repeatedly operated, the elapsed time from the last operation is measured. Here, the predetermined time period is, for example, approximately five seconds.

In ACT 404, when it is determined that the predetermined time period has not elapsed, the processing proceeds to ACT 405. In ACT 405, the control circuit 12 determines not to change the mode, and completes the mode change determination processing. Since the mode change determination processing is repeatedly performed, when the predetermined time period has elapsed since the last operation mode change processing was performed, the processing proceeds to ACT 403.

For example, when the initial setting mode is the non-decolorable printing mode and the blue icon 321 is selected for the first time, it is determined to change the mode to the decolorable printing mode. At this time, the temperature of the heat roller 151 is changed from 130° C. which is the reference temperature of the non-decolorable printing while 100° C. which is the reference temperature of the decolorable printing is the target value. The black and white icon 322 is selected while the temperature is being lowered. At this time, the processing proceeds to ACT 404 and does not immediately change the operation mode. In other words, the temperature of the fixing device 150 is subsequently lowered toward 100° C.

When the selection of the black and white icon 322 of the user is an erroneous operation, it is assumed that the user reselects the blue icon 321. When the predetermined time period has elapsed after reselecting the blue icon 321, it is determined that the operation mode is the decolorable printing, and thus, the temperature of the fixing device 150 is adjusted to 100° C.

Meanwhile, when the selection of the black and white icon 322 of the user is not an erroneous operation, it is assumed that the user does not operate the icon for changing the operation mode. When a predetermined time period has elapsed since the black and white icon 322 was selected, the operation mode is changed to the non-decolorable printing. At this time, the temperature of the heat roller 151 is raised again to 130° C.

As described above, after the operation mode is changed from the initial setting, the operation mode is changed when it is apparent that the operation for changing the operation mode is the intention of the user. In other words, when the blue icon 321 or the black and white icon 322 is selected, the operation mode is changed when the predetermined time period has elapsed without reselecting the icon. According to the example, the temperature of the fixing device 150 is unnecessarily changed, and as a result, the time period until starting the printing is prevented from becoming longer.

In the above-described example, an example in which the temperature of the heat roller 151 of the fixing device 150 is changed when the operation mode is changed is described, but the temperature of the fixing belt 153 may also be changed.

Decolorizing Mode

In the above-described embodiments, a case where the state is switched in two operation modes, such as the non-decolorable printing and the decolorable printing, has been described as an example. However, the options of the operation mode are not limited to two. In the image forming and image erasing apparatus, a decolorizing mode can be selected. In the decolorizing mode, the temperature of the heat roller 151 of the fixing device 150 is adjusted to approximately 120° C. while 120° C. is a reference temperature.

When the decolorizing mode is selected, a target standby temperature in ACT 104 is set to 120° C. which is the reference temperature of the decolorizing mode. Further, when the instruction to start the operation is input in a state where the decolorizing mode is selected, the designating operation performed in ACT 109 is a decolorizing operation. In other words, processing of heating the paper sheet to be decolorized by the fixing device 150 and decolorizing the decolorable toner is performed.

In addition, even when the decolorizing mode can be selected, a configuration in which unnecessary change of the operation mode due to an erroneous operation by the user is prevented when the operation mode is changed from the initial setting may be adopted. In other words, the mode determination processing described with reference to FIG. 8 or the mode determination processing described with reference to FIG. 9 may be performed.

Further, in the decolorizing mode, the reference temperature of the fixing belt 153 may be set to 120° C. in order to decolorize both sides of the sheet 200. In this case, the fixing belt 153 can also be heated in accordance with the mode change from the non-decolorable printing mode or the decolorable printing mode. In addition, when changing the mode from the decolorizing mode to the non-decolorable printing mode or the decolorable printing mode, the fixing belt 153 is cooled.

The decolorizing mode may be prepared as a mode different from the above-described copy mode. In this case, when the mode is changed from the copy mode to the decolorizing mode, the same temperature control of the fixing device as that in the above-described example can be performed.

Furthermore, there is a case where the temperature setting of the fixing device 150 are made different between the black and white printing and the color printing. In this case, similar to the above-described embodiments, the temperature setting of the fixing device in the standby state can be performed in accordance with the printing mode including the distinction between the black and white printing and the color printing.

Variation of Standby Temperature

In the above-described embodiments, the temperature of the fixing device 150 changed in ACT 104 is described as the reference temperature illustrated in FIG. 4. When the operation mode is changed, there is a possibility that the operation mode further changes thereafter. When the difference between the operation temperature and the standby temperature is large, the time period until starting the designating operation can become longer. Therefore, when the operation mode is changed from the initial setting, the standby temperature may be set to a temperature at which the temperature of the fixing device can be easily adjusted to the reference temperature regardless of what kind of operation is executed. Specifically, the standby temperature may be set to a temperature between the reference temperature of the non-decolorable printing and the reference temperature of the decolorable printing. In other words, the standby temperature may be set to a temperature between the reference temperature of the operation mode before the change and the reference temperature of the operation mode after the change. Here, it may be considered that it takes a longer time to lower the temperature by cooling than to raise the temperature by heating.

Figures 9, 10:
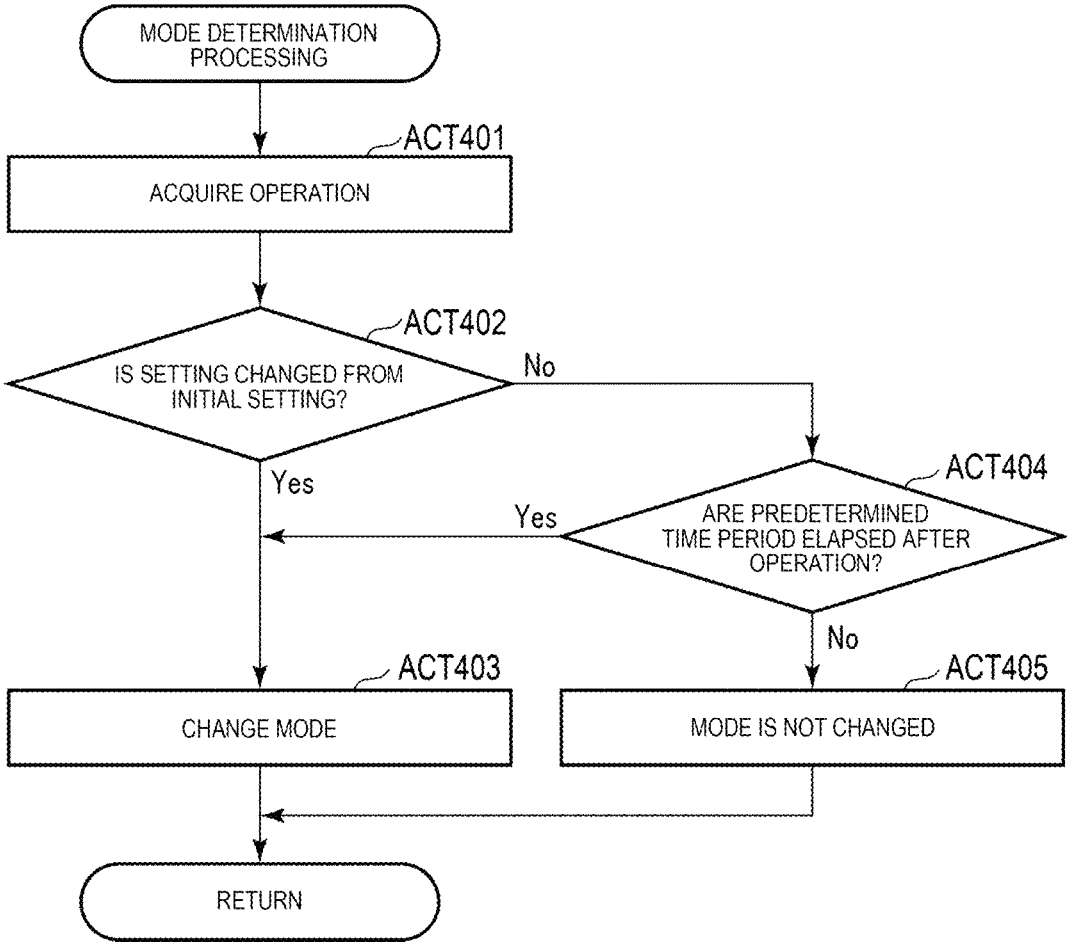
FIG. 9 is a flowchart schematically illustrating a second modification example of the mode determination processing.
FIG. 10 is a view illustrating an example of a reference temperature and a standby temperature of a heat roller of the fixing device in each operation mode.

For example, the standby temperature of the heat roller 151 of the fixing device 150 may be set to a temperature as illustrated in FIG. 10. In other words, the standby temperature at the start of standby is the same as the reference temperature in any operation mode. Meanwhile, the standby temperature after changing the operation mode is different from the reference temperature. For example, when the operation mode after the change is the non-decolorable printing mode, the target value of the standby temperature is set to 115° C. When the operation mode after the change is the decolorable printing mode, the target value of the standby temperature is set to 110° C. When the operation mode after the change is the decolorizing operation mode, the target value of the standby temperature is set to 110° C.

For example, it is assumed that the initial setting is the non-decolorable printing and the initial standby temperature of the fixing device 150 is 130° C. Here, the operation mode is changed to the decolorable printing. In this case, the standby temperature is changed to 110° C. When the temperature is cooled to 110° C., and when execution of the decolorable printing is commanded, the heat roller 151 of the fixing device 150 can be cooled to 100° C. which is the operating temperature in a relatively short time period. In addition, even when the operation mode is changed again to the non-decolorable printing and the execution of the non-decolorable printing is commanded immediately, the heat roller 151 can be heated to 130° C. which is the operating temperature in a relatively short time period.

The initial setting is the decolorable printing and the initial standby temperature is 100° C. Here, the operation mode is changed to the non-decolorable printing. In this case, the standby temperature is changed to 115° C. When the temperature is heated to 115° C., and when execution of the non-decolorable printing is commanded, the fixing device 150 can be heated to 130° C. which is the operating temperature in a relatively short time period. In addition, even when the operation mode is changed again to the decolorable printing and the execution of the decolorable printing is commanded immediately, the fixing device 150 can be cooled to 100° C. which is the operating temperature in a relatively short time period.

Here, while the standby temperature is set to 115° C. when the non-decolorable printing is selected, the standby temperature is set to 110° C. when the decolorable printing is selected, and the reason thereof is as follows. When the non-decolorable printing is selected, it is expected that the operation to be executed is the non-decolorable printing. Therefore, the operation stands by at a higher temperature than that when the decolorable printing is selected. Conversely, when the decolorable printing is selected, it is expected that the operation to be executed is the decolorable printing. Therefore, the operation stands by at a lower temperature than that when the non-decolorable printing is selected. The standby temperature is biased toward the lower temperature side than the intermediate temperature between the reference temperature for the non-decolorable printing and the reference temperature of the decolorable printing because the time period required for cooling is longer than the time period required for heating.

Figure 11:
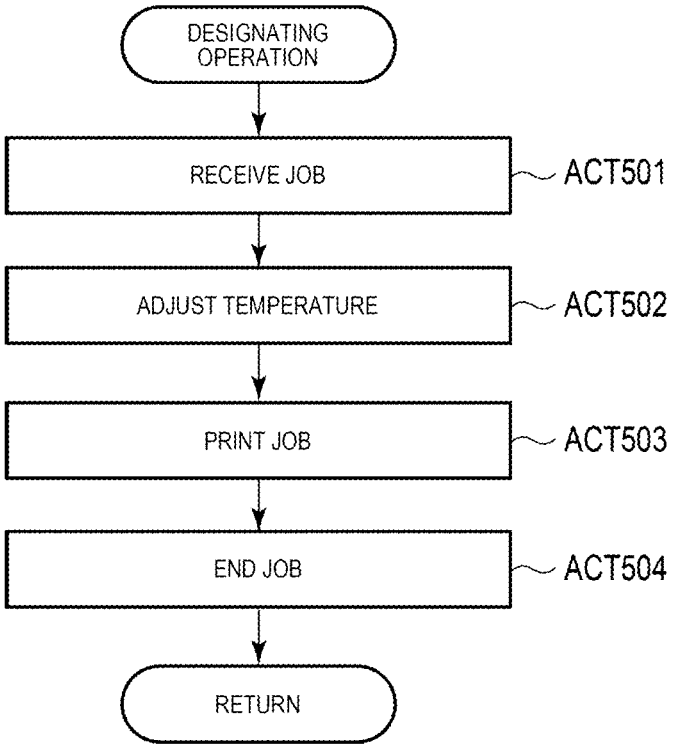
FIG. 11 is a flowchart schematically illustrating a modification example of the printing operation.

When the standby temperature is not the reference temperature of the selected operation mode, it is necessary to change the temperature of the fixing device 150 to the reference temperature during the operation. Therefore, when executing the printing during the designating operations performed in ACT 109, the operation is performed as illustrated in the flowchart of FIG. 11.

In ACT 501, the control circuit 12 causes the scanner unit 50 to scan the document and receives a print job. In ACT 502, the control circuit 12 heats or cools the temperature of the fixing device 150 to an appropriate temperature close to the reference temperature. In ACT 503, the control circuit 12 executes the printing in accordance with the received job. After the printing, in ACT 504, the control circuit 12 completes the job. Accordingly, the designating operation related to the printing is completed. Even in a case of decolorizing, similarly, the control circuit 12 heats or cools the temperature of the fixing device 150 to an appropriate temperature close to the reference temperature and performs the decolorizing operation.

Through the above-described processing, when the operation mode is changed from the initial setting having a possibility that the operation mode is changed immediately before the operation, the time period until starting the operation can be shortened.

The setting of the standby temperature may be used in combination with any of the above-described embodiments or modification examples.

Others

In the printing fixing, both of heating by the heat roller 151 and heating by the fixing belt 153 may be used, or one of the heating may be used. There may be various combinations of the reference temperature of the heat roller 151 and the reference temperature of the fixing belt 153. Based on the reference temperatures, the temperature control of the heat roller 151 and the fixing belt heat roller 155 is performed similarly to the above-described embodiments. In this manner, the above-described temperature and the like is an example, and the above-described temperature can be appropriately changed depending on various conditions.

In the above-described embodiments, a case where any of the non-decolorable printing and the decolorable printing is selected, and a case where any of the non-decolorable printing, the decolorable printing, and the decolorizing operation is selected, is described, but the exemplary embodiments are not limited thereto. The above-described technique can also be applied to a case where any of the operation modes is selected among the options while at least two or more among the non-decolorable printing, the decolorable printing, and the decolorizing operation are options.

In the above-described embodiments, the description has been made as an operation related to the copying. The above-described technique can also be applied to functions other than copying, such as printing functions. In this case, the image forming apparatus 1 first receives the setting related to the operation mode from a connected PC, for example. The standby temperature of the fixing device 150 is changed in accordance with the received setting. Thereafter, the image forming apparatus 1 receives the print job. In this case, the temperature of the fixing device 150 is adjusted in advance in accordance with the operation mode. Therefore, the time period from the reception of the print job to the start of the printing is shorter than the time period for the adjustment of the temperature of the fixing device 150 from the reception of the print job.

In the above-described embodiments, the image forming apparatus 1 has been described as a digital multifunction peripheral having various functions. However, the above-described technique is not limited to being applied to a multifunction peripheral. The above-described technique may be used for the digital multifunction peripheral that lacks some of the functions of the above-described digital multifunction peripheral. Further, for example, the technique may be used for a copy machine having only a copy function, a printer having only a print function, or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming unit configured to form an image on a sheet by using toner;

a fixing device configured to heat the image to fix on the sheet; and a control circuit configured to determine an instruction to change an operation mode to a first mode in which the image is formed using first toner or a second mode in which the image is formed using second toner;

control heating of the fixing device so as to (i) perform heating to a first fixing reference temperature upon receiving a first image formation instruction in the first mode, (ii) perform heating to a second fixing reference temperature upon receiving a second image formation instruction in the second mode, the second fixing reference temperature being lower than the first fixing reference temperature, and (iii) perform heating to a first standby temperature upon receiving an instruction to change the operation mode a predetermined number of times before receiving a third image formation instruction in the second mode, the first standby temperature being between the first fixing reference temperature and the second fixing reference temperature; and control the fixing device to perform heating to a second standby temperature upon receiving an instruction to change the operation mode to the first mode from the second mode a predetermined number of times before receiving a fourth image formation instruction in the first mode, the second standby temperature being between the first fixing reference temperature and the second fixing reference temperature, wherein the first toner is non-decolorable toner, and the second toner is decolorable toner.

2. The image forming apparatus according to claim 1, wherein the first standby temperature is higher than the second standby temperature.

3. The image forming apparatus according to claim 2, wherein the control circuit is further configured to determine an instruction to change the operation mode to a third mode in which an image formed using a second toner is decolorized; and control the fixing device to (i) perform heating to a decolorizing reference temperature upon receiving a decolorizing instruction in the third mode; and (ii) perform heating to a third standby temperature upon receiving an instruction to change the operation mode to the third mode from the first mode or the second mode a predetermined number of times before receiving the decolorizing instruction in the third mode, the third standby temperature being between the first fixing reference temperature and the second fixing reference temperature.

4. The image forming apparatus according to claim 3, wherein the second standby temperature is the same temperature as the third standby temperature.

5. The image forming apparatus according to claim 1, wherein the control circuit is configured to set the first standby temperature to a target value.

6. A method of controlling an image forming apparatus including an image forming unit configured to form an image on a sheet by using toner, and a fixing device configured to heat the image to fix on the sheet, the method comprising:

determining, by a control circuit, an instruction to change an operation mode to a first mode in which the image is formed using first toner or a second mode in which the image is formed using second toner;

controlling, by the control circuit, heating of the fixing device to cause the fixing device to (i) perform heating to a first fixing reference temperature upon receiving a first image formation instruction in the first mode, (ii) perform heating to a second fixing reference temperature upon receiving a second image formation instruction in the second mode, the second fixing reference temperature being lower than the first fixing reference temperature, and (iii) perform heating to a first standby temperature upon receiving an instruction to change the operation mode a predetermined number of times before receiving a third image formation instruction in the second mode, the first standby temperature being between the first fixing reference temperature and the second fixing reference temperature; and controlling the fixing device to perform heating to a second standby temperature upon receiving an instruction to change the operation mode to the first mode from the second mode a predetermined number of times before receiving a fourth image formation instruction in the first mode, the second standby temperature being between the first fixing reference temperature and the second fixing reference temperature, wherein the first toner is non-decolorable toner, and the second toner is decolorable toner.

7. The method according to claim 6, wherein the first standby temperature is higher than the second standby temperature.

8. The method according to claim 7, further comprising:

determining an instruction to change the operation mode to a third mode in which an image formed using a second toner is decolorized; and controlling the fixing device to (i) perform heating to a decolorizing reference temperature upon receiving a decolorizing instruction in the third mode; and (ii) perform heating to a third standby temperature upon receiving an instruction to change the operation mode to the third mode from the first mode or the second mode a predetermined number of times before receiving the decolorizing instruction in the third mode, the third standby temperature being between the first fixing reference temperature and the second fixing reference temperature.

9. The method according to claim 8, wherein the second standby temperature is the same temperature as the third standby temperature.

10. The method according to claim 6, further comprising setting the first standby temperature to a target value.

* * * * *